US005740920A

United States Patent [19]

Timmermann

[11] Patent Number: 5,740,920

[45] Date of Patent: Apr. 21, 1998

[54] JIGGING SCREEN DEVICE WITH PNEUMATIC VALVE CONTROL

[75] Inventor: Helmut Timmermann, Bochum, Germany

[73] Assignee: Ruhrkohle Aktiengesellschaft, Essen, Germany

[21] Appl. No.: 501,097

[22] PCT Filed: Dec. 29, 1993

[86] PCT No.: PCT/DE93/01259

§ 371 Date: Jul. 28, 1995

§ 102(e) Date: Jul. 28, 1995

[87] PCT Pub. No.: WO94/16819

PCT Pub. Date: Aug. 4, 1994

[30] Foreign Application Priority Data

Jan. 30, 1993 [DE] Germany ..... 43 02 672.9

[51] Int. Cl.[6] ..... B03B 5/52

[52] U.S. Cl. ..... 209/455; 209/502; 137/596.16; 251/129.17

[58] Field of Search ..... 209/455, 457, 209/475, 502; 137/596.16; 251/60, 129.01, 129.02, 129.17, 284, 285

[56] References Cited

U.S. PATENT DOCUMENTS

| | | | |
|---|---|---|---|
| 1,789,516 | 1/1931 | Crangle | 209/455 |
| 3,012,751 | 12/1961 | Hauser | 251/285 X |
| 3,285,414 | 11/1966 | Bosman | 209/457 |
| 4,019,981 | 4/1977 | Stern et al. | 209/455 |
| 4,353,392 | 10/1982 | Ruchser et al. | 137/596.16 |
| 4,832,835 | 5/1989 | Strauss et al. | 209/502 X |
| 5,454,399 | 10/1995 | Kazakis et al. | 137/596.16 |

FOREIGN PATENT DOCUMENTS

| | | | |
|---|---|---|---|
| 1217292 | 3/1964 | Germany . | |
| 3531239 | 3/1987 | Germany . | |
| 1192856 | 11/1985 | U.S.S.R. | 209/455 |
| 1614846 | 12/1990 | U.S.S.R. . | |
| 289633 | 5/1928 | United Kingdom . | |

OTHER PUBLICATIONS

Siegfried Heintges; Neue Austragsreggeiung . . . Trenndichten; 1987; pp. 693–696.

J. van Gemerden; Technische . . . werktuigbouwkundigen; Oct. 1982; pp. 432–433.

BATAC–Setzmaschinen; Jul. 1984; KHD Humboldt Wedag AG.

*Primary Examiner*—Tuan Nguyen

*Attorney, Agent, or Firm*—Robert W. Becker & Associates

[57] ABSTRACT

A pneumatic jigging screen device has an air chamber for generating pulsation which is connected to a compressed air source. An air outlet is provided. An air inlet valve in the form of a disk valve is connected between the compressed air source and the air chamber and includes a valve rod. An air outlet valve in the form of a disk valve is connected between the air chamber and the air outlet and includes a valve rod. A first pneumatic valve drive is coupled to the valve rod of the air inlet valve. A second pneumatic valve drive is coupled to the valve rod of the air outlet valve. A first electromagnetic control valve is connected between the first pneumatic valve drive and the compressed air source. A second electromagnetic control valve is connected between the second pneumatic valve drive and the compressed air source.

12 Claims, 3 Drawing Sheets

JIGGING SCREEN DEVICE WITH PNEUMATIC VALVE CONTROL

BACKGROUND OF THE INVENTION

The invention relates to a pneumatic jigging screen device with an air chamber for generating the pulsation, which air chamber is connected via an inlet valve with a compressed air source and via an outlet valve with an outlet, whereby the inlet and outlet valves are embodied as disk valves connected respectively via a valve rod to a pneumatically actuatable valve drive.

A jigging screen device having the aforementioned features, which separates the supplied materials in a pulsating water bath according to their specific gravity, is known from the company brochure "BATAC-Setzmaschinen" 4-202 of the Company KHD Humboldt Wedag AG, 7-84. The pulsating water bath is generated by the cycled supply, respectively, removal of compressed air. The supply of compressed air, respectively, the removal of the air cushion takes place via controlled valves which, besides mechanical or electrical valve drives, can also be pneumatically actuated as especially in the BATAC jigging screen device. With the known pneumatic valve drives the disadvantage is encountered that external energy in the form of seperately supplied compressed air as control air is required for the actuation of the pneumatic valve drives.

From German patent 1 217 292 a pneumatic jigging screen device of the aforementioned kind is known in which the pneumatically driven disk valves are controlled by electromagnetic control valves whereby, however, in this prior art device a separate compressed air network for supplying the control air must be provided.

It is therefore an object of the invention to lower for a jigging screen device of the aforementioned kind the energy consumption and to improve the precision of the valve control.

SUMMARY OF THE INVENTION

A pneumatic jigging screen device according to the present invention is primarily characterized by:

an air chamber;

a compressed air source for generating pulsation in the air chamber;

an air outlet;

an air inlet valve in the form of a disk valve connected between the compressed air source and the air chamber, the air inlet valve including a valve rod;

an air outlet valve in the form of a disk valve connected between the air chamber and the air outlet, the air outlet valve including a valve rod;

a first pneumatic valve drive coupled to the valve rod of the air inlet valve;

a second pneumatic valve drive coupled to the valve rod of the air outlet valve;

a connecting line connecting the compressed air source to the first and second valve drives;

a first electromagnetic control valve positioned between the first pneumatic valve drive and the compressed air source in the connecting line; and a second electromagnetic control valve positioned between the second pneumatic valve drive and the compressed air source in the connecting line.

Each one of the first and second pneumatic valve drives preferably comprises a pressure-tight housing and a diaphragm positioned therein, wherein the diaphragm is connected to the valve rod.

Advantageously, each one of the first and second pneumatic valve drives is a piston-cylinder drive acting on the valve rod.

Preferably, each one of the electromagnetic control valves is a 4/3-way valve.

Expediently, each one of the disk valves comprises a spring for biasing the disk valve into a closed position and each one of the electromagnetic control valves is a 3/2-way valve.

The sluggishness of each one of the disk valves, defined by a ratio of a working surface of the diaphragm to a surface area of the disk valve, is preferably at most as great as the sluggishness of the corresponding one of the first and second electromagnetic control valves.

Expediently, each one of the disk valves further comprises a stroke-limiting device for limiting the stroke of the valve rod.

The stroke-limiting device preferably comprises a position-adjustable stop plate positioned in the housing for stopping the free end of the valve rod extending into the housing. Advantageously, the stroke-limiting device further comprises a hydraulic cylinder for position-adjusting the stop plate.

In the alternative, the stroke-limiting device comprises a stop seated on the valve rod, the stop comprising a locking hook fixedly connected to the housing and serving as a mechanical abutment. Preferably, the locking hook is height-adjustable. Advantageously, the locking hook is pivotable out of a path of movement of the stop seated on the valve rod.

The invention is based on the basic principle that the pneumatically actuatable valve drives for the inlet and outlet valves are connected with interposition of electromagnetic control valves to the compressed air source of the jigging screen device. The invention has thus the advantage that the air pressure for operating the jigging screen device, which is present within the compressed air inlet area, can also be used for the control of the inlet valve as well as the outlet valve so that no supply of external energy is required. This results in an overall reduction of the energy consumption of the jigging screen device so that respective compressor devices for generating the external energy are obsolete. Due to the coupling of the control of the valve drives to the supply of compressed air for the jigging screen device, the expenditure for the control is also reduced and the precision of the control is improved because the valve control takes automatically into account the conditions within the compressed air inlet area. The remaining expenditure of external energy for the electromagnetic control valves is negligible.

According to one embodiment of the invention the respective valve drive is in the form of a diaphragm drive of a plunger embodiment having a diaphragm connected to the valve rod and being positioned within a pressure-tight housing. This results in the special advantage that for the air pressure commonly present within the compressed air inlet area for controlling the valves, the reaction determind by the ratio of working surface of the valve drive to the valve surface area of the inlet valve, respectively, outlet valve, which reaction defines the response time, can be adjusted with the required precision. A further advantage results from the fact that for an installed jigging screen device an adaptation of the control to changing operation conditions is easily possible by adapting the diaphragm within the valve drive.

A similar diaphragm drive for a valve is disclosed in context with a jigging screen device in British Patent 289

633 wherein, however, the actuation of the valve is coupled to a flap which functions as an indicator for the material supply into the settling chamber of the jigging screen device so that for an interrupted material supply the compressed air inlet line is opened and the compressed air supplied to the jigging screen device can escape into the atmosphere. The control of the otherwise provided inlet valve and outlet valve of the jigging screen device is not addressed in this context.

However, an embodiment of the valve as a piston-cylinder drive, known per se, for the valve rod is also feasible.

Expediently, the embodiment of the electromagnetic control valve for the compressed air supply of the valve drive is in the form of a 4/3 way valve in which the closed center position of the control valve ensures a leak-free closed position of the corresponding inlet valve, respectively, outlet valve.

Alternatively, the disk valve can also be pre-stressed by a pre-stressed spring into its closed position and the electromagnetic control valve for the compressed air supply of the valve drive can be embodied as a 3/2 way valve whereby due to the spring bias of the disk valve into its closed position an electromagnetic control valve with two switching positions is sufficient for controlling the valve drive. A disk valve which is prestressed into its closed position with a spring arrangement is known, in principle, from J. Van Gemerden: "technische informatie voorwerktuigbouwkundigen", 1982, STAM TECHNISCHE BOEKEN BV, Culemborg, Netherlands, p. 432.

In order to allow for an adjustability of the control of the jigging screen device with the required precision, it is suggested that the response time determined by the ratio of the working surface of the valve drive to the valve surface area of the disk valve is adjusted with a sluggishness which is not greater than the sluggishness of the electromagnetic control valve.

According to another embodiment of the invention a stroke-limiting device can be provided for selecting the stroke of the valve rod which stroke-limiting device, in one embodiment, is comprised of a stop, adjustable with external energy and extending into the housing of the valve drive, for the upper end of the valve rod and, in another embodiment, is in the form of a stop seated on the valve rod which has coordinated therewith a locking hook as a mechanical abutment. The advantage of the stroke-limiting device lies in an additional control possibility for limiting the opening stroke of the valve. A respective valve actuation with stroke limitation is known from German Offenlegungsschrift 35 31 239.

Inasmuch as a stop for the upper end of the valve rod is provided, which is adjusted with external energy, this stop can be in the form of a stop plate arranged within the housing of the valve drive and position-adjustable via a hydraulic cylinder so that this stop plate can simultaneously serve as a dampening buffer. This is, in general, known from DE 35 31 239.

Since certain operation situations, for example, startup of the jigging screen device when the machine is, may require that the inlet cross-section of the inlet valve is to be opened fully for a short period of time, a removal of the stroke limitation in some embodiments of the invention is suggested which may be realized, for abutments controlled with external energy, within the control of the stop plate. Inasmuch as a mechanical stroke-limiting device is provided according to the invention, the locking hook which acts on the stop seated on the valve rod is, according to one embodiment of the invention, pivotable out of engagement.

BRIEF DESCRIPTION OF THE DRAWINGS

In the drawings embodiments of the invention are represented which will be explained in the following. It is shown in.

DESCRIPTION OF PREFERRED EMBODIMENTS

Figure 1:
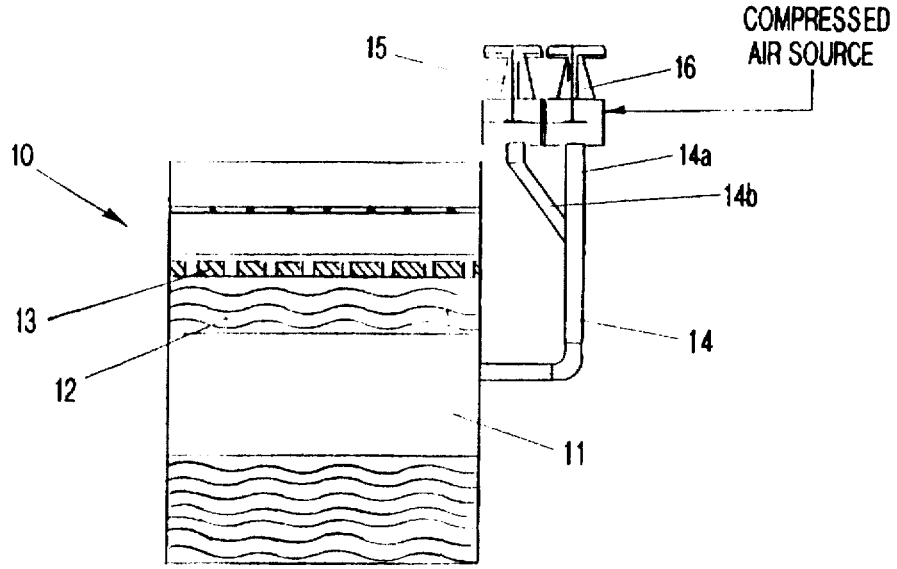
FIG. 1 a schematic representation of a jigging screen device in a bottom-pulsed embodiment.

FIG. 1 shows an individual settling chamber 10 of a jigging screen device of the type "bottom-pulsed" in which an air chamber 11 is arranged within the water bath 12 of the jigging screen device below the support 13 for the settled material. The air chamber 11 is connected, on the one hand, to the outlet valve 15 and, on the other hand, to the inlet valve 16 via a line 14 which branches into a supply line **14*a* and into an outlet line 14*b*. The inlet valves 16 of a plurality settling chambers 10** of a jigging screen device, connected in series, are connected to a single compressed air inlet line which is not represented.

Figure 2:
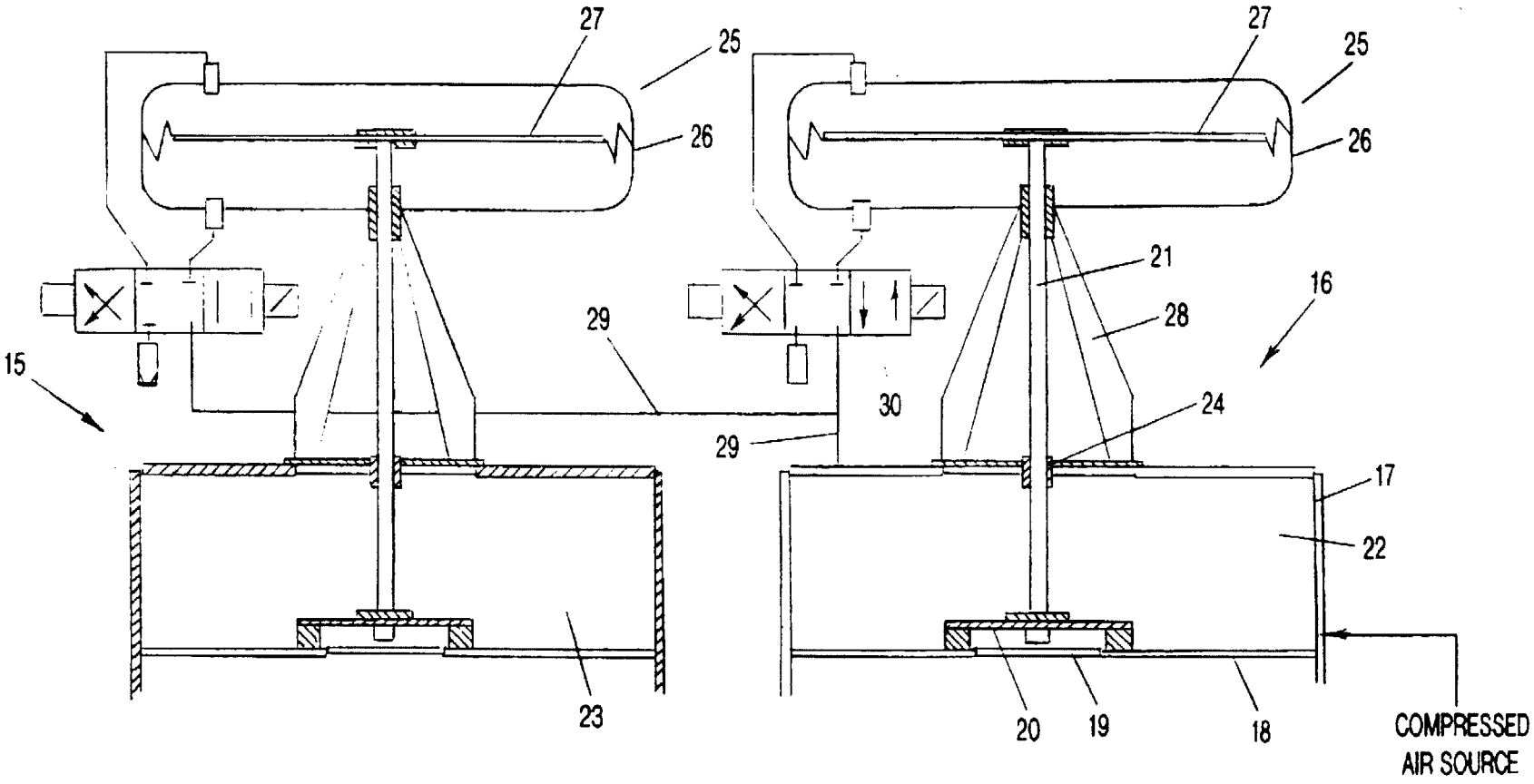
FIG. 2 inlet and outlet valves with corresponding valve drives in a schematic representation.

As can be seen more clearly from FIG. 2, the inlet valve 16 comprises a valve chamber 17 with a partition 18 arranged therein in which a valve opening 19 is provided. The valve opening 19 can be closed, respectively, opened with a disk valve 20 whereby the disk valve 20 is moveable via a valve rod 21 between its open and its closed position. For the inlet valve 16, the pressure chamber 22, arranged above the partition 18, is associated with the compressed air inlet area and the air pressure present therein, while the corresponding chamber 23 of the outlet valve 15 is associated with the air outlet area and the ambient pressure present therein.

The valve rod 21 is guided outwardly from the valve chamber 17 via a seal 24 and extends into a pressure-tight housing 26 of a pneumatic valve drive 25. In the housing 26, diaphragm 27 is arranged to which is connected the valve rod 21. In the represented embodiment the shown stretched rest position of the diaphragm 27 corresponds to the closed position of the disk valve 20. Other arrangements are however possible, for example, a positioning of the diaphragm in one of its end positions so as to correspond substantially to half the stroke. The housing 26 of the valve drive 25 is supported at the valve chamber 17 of the inlet valve, respectively, outlet valve with support elements 28.

The valve drive 25 of the inlet valve 16 and the outlet valve 15 are connected via a line 29 having a respective electromagnetic control valve 30 positioned therein to the pressure chamber 22 of the inlet valve 16. The control valve 30 is a 4/3 way valve of conventional design with three switching positions whereby the right switching position represented in the drawing serves to open the disk valve 20 by displacement of the diaphragm 27, and thus of the valve rod 21, in the upward position and the left switching position in the representation corresponds to the closure of the disk valve 20 by displacement of the diaphragm 27 with the valve rod 21 in the downward direction into its initial position. The central locking position of the valve 30 serves for a leak-free closure of the inlet valve, respectively, outlet valve in the respective cycle phase during opening of the respective other valve.

Figure 3:
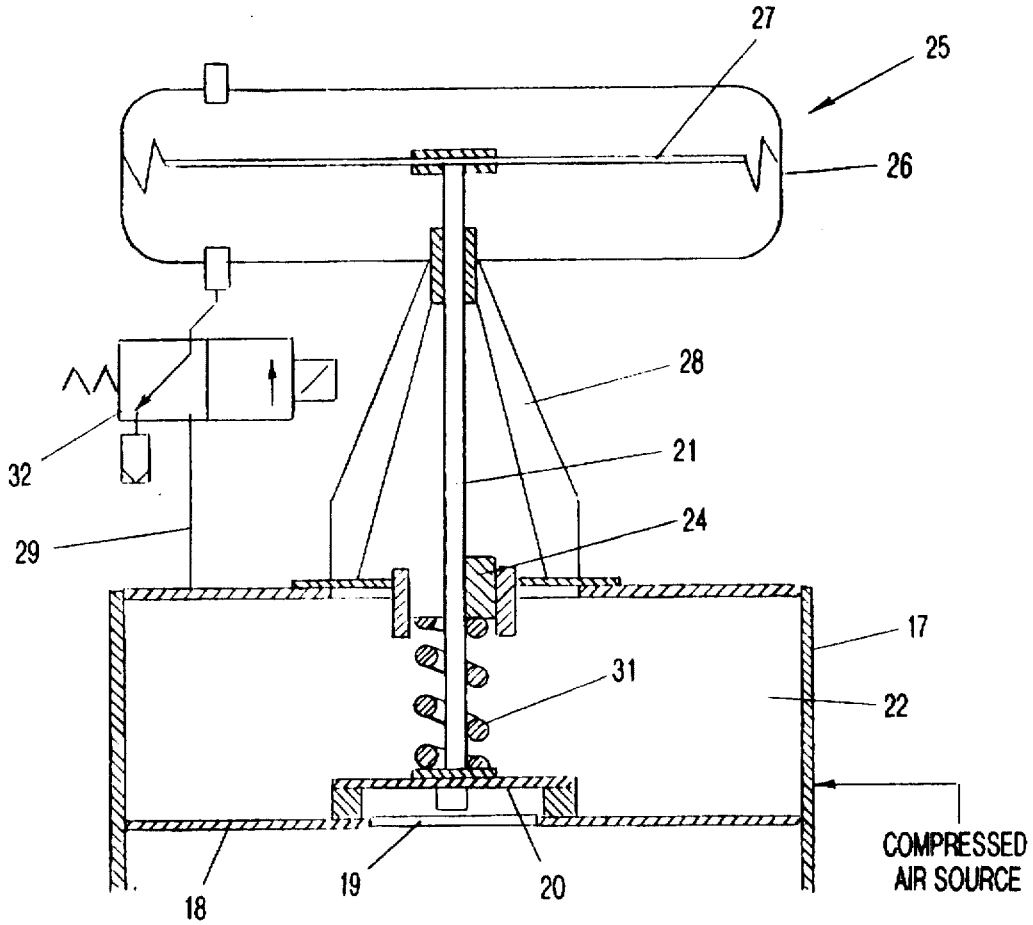
FIG. 3 an inlet valve with valve drive in another embodiment.

In the embodiment represented in FIG. 3 the spring 31 provides bias of the disk valve 20 into its closed position whereby the spring 31 is supported between a corresponding wall of the valve chamber 17 and the disk valve 20. In this embodiment the corresponding electromagnetic control valve is a 3/2 way valve with two switching positions whereby the switching positions, on the one hand, serve to open the disk valve 20 by displacement of the diaphragm 27 in the upward direction and, on the other hand, serve to remove the control air during the closing movement of the valve caused by the action of the spring 31.

The aforementioned electromagnetic control valves 30, 32 in the form of a 4/3 way valve as well as in the form of a 3/2 way valve are conventional control valves so that no technical discussion is required.

Figure 4:
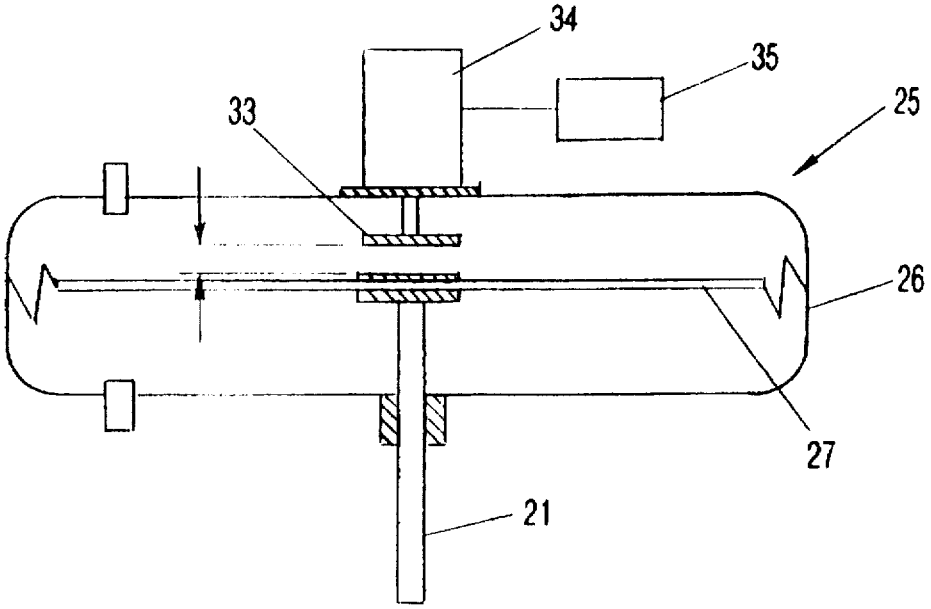
FIG. 4 a valve drive with stroke-limiting device in a schematic representation.
Figure 5:
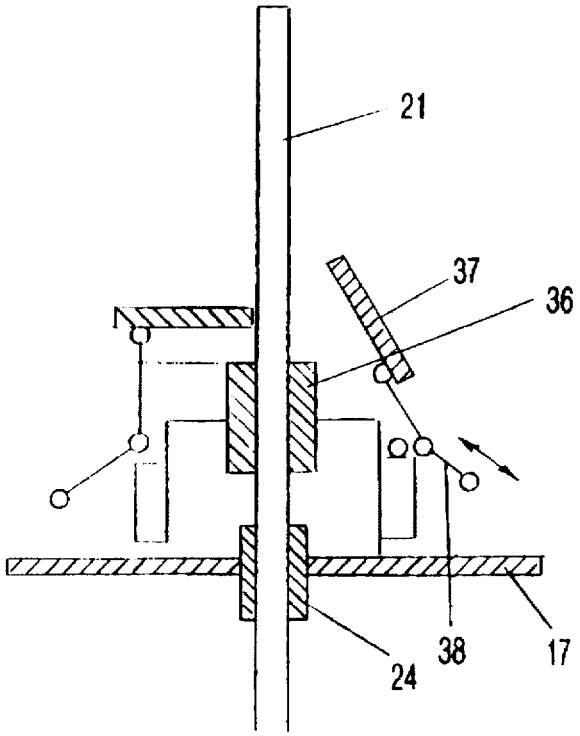
FIG. 5 the device of FIG. 4 in another embodiment.

In FIGS. 4 and 5, a stroke-limiting device for the opening movement of the disk valve 20 with valve rod 21 is represented. In the embodiment of FIG. 4, a stop plate 33 is provided in the housing 26 of the valve drive 25 which is associated with the upper end of the valve rod 21 which is position-adjustable via a coordinated piston rod of a hydraulic cylinder 34 arranged exterior to the housing 26. The hydraulic cylinder 34 is controlled by a control 35 such that the stroke of the valve rod 21 is adjustable and the stroke limitation caused by the stop plate 33 can be completely removed. In this embodiment of the stroke-limiting device the stop plate simultaneously serves as a dampening device because the position adjustment with a hydraulic cylinder is respectively yielding.

In the embodiment of the stroke-limiting device represented in FIG. 5, the valve rod 21 carries a stop 36 having coordinated therewith a locking hook 37 which is fixedly connected to the housing but, in an advantageous embodiment, is height-adjustable. The locking hook 37 is fixed in its position with an elbow lever device 38 but is pivotable away from its locked position for the stop 36 by actuating the elbow lever 38. Thus, it is possible in certain operational situations, as, for example, upon startup of an overfilled machine, to open fully the inlet cross-section of the disk valve 20 while ignoring the adjusted stroke-limitation.

The features of the inventive object of this application disclosed in the above description, the claims, the abstract, and the drawing may be important individually as well as in any desired combination for the realization of the invention in its various embodiments.

The present invention is, of course, in no way restricted to the specific disclosure of the specification and drawings, but also encompasses any modifications within the scope of the appended claims.

What I claim is:

1. A pneumatic jigging screen device comprising:

an air chamber;

a compressed air source for generating pulsation in said air chamber;

an air outlet;

an air inlet valve in the form of a disk valve connected between said compressed air source and said air chamber, said air inlet valve including a valve rod;

an air outlet valve in the form of a disk valve connected between said air chamber and said air outlet, said air outlet valve including a valve rod;

a first pneumatic valve drive coupled to said valve rod of said air inlet valve;

a second pneumatic valve drive coupled to said valve rod of said air outlet valve;

a connecting line connecting said compressed air source to said first and second valve drives;

a first electromagnetic control valve positioned between said first pneumatic valve drive and said compressed air source in said connecting line; and a second electromagnetic control valve positioned between said second pneumatic valve drive and said compressed air source in said connecting line.

2. A pneumatic jigging screen device according to claim 1, wherein each one of said first and second pneumatic valve drives comprises a pressure-tight housing and a diaphragm positioned therein, wherein said diaphragm is connected to said valve rod.

3. A pneumatic jigging ,screen device according to claim 1, wherein each one of said first and second pneumatic valve drives is a piston cylinder drive acting on said valve rod.

4. A pneumatic jigging screen device according to claim 1, wherein each one of said electromagnetic control valves is a 4/3-way valve.

5. A pneumatic jigging screen device according to claim 1, wherein each one of said disk valves comprises a spring for biasing said disk valve into a closed position and wherein each one of said electromagnetic control valves is a 3/2-way valve.

6. A pneumatic jigging screen device according to claim 2, wherein the sluggishness of each one of said disk valves, defined by a ratio of a working surface of said diaphragm to a surface area of said disk valve, is at most as great as the sluggishness of the corresponding one of said first and second electromagnetic control valves.

7. A pneumatic jigging screen device according to claim 2, wherein each one of said disk valves further comprises a stroke-limiting device for limiting the stroke of said valve rod.

8. A pneumatic jigging screen device according to claim 7, wherein said stroke-limiting device comprises a position-adjustable stop plate positioned in said housing for stopping the free end of said valve rod extending into said housing.

9. A pneumatic jigging screen device according to claim 8, wherein said stroke-limiting device further comprises a hydraulic cylinder for position-adjusting said stop plate.

10. A pneumatic jigging screen device according to claim 7, wherein said stroke-limiting device comprises a stop seated on said valve rod, said stop comprising a locking hook fixedly connected to said housing and serving as a mechanical abutment.

11. A pneumatic jigging screen device according to claim 10, wherein said locking hook is height-adjustable.

12. A pneumatic jigging screen device according to claim 10, wherein said locking hook is pivotable out of a path of movement of said stop seated on said valve rod.

* * * * *